US009126095B2

(12) United States Patent
Wøllo et al.

(10) Patent No.: US 9,126,095 B2
(45) Date of Patent: Sep. 8, 2015

(54) TOURING OR CROSS-COUNTRY SKI BINDING

(75) Inventors: Even Wøllo, Naersnes (NO); Thomas Holm, Oslo (NO); Øyvar Svendsen, Oslo (NO); Aksel Pettersen, Drøbak (NO)

(73) Assignee: Rottefella AS, Klokkarstua (NO)

( * ) Notice: Subject to any disclaimer, the term of this patent is extended or adjusted under 35 U.S.C. 154(b) by 0 days.

(21) Appl. No.: 13/822,678

(22) PCT Filed: Sep. 15, 2011

(86) PCT No.: PCT/NO2011/000253

§ 371 (c)(1),
(2), (4) Date: May 17, 2013

(87) PCT Pub. No.: WO2012/036561

PCT Pub. Date: Mar. 22, 2012

(65) Prior Publication Data

US 2013/0313807 A1 Nov. 28, 2013

(30) Foreign Application Priority Data

Sep. 15, 2010 (NO) ..... 20101289

(51) Int. Cl.

| | |
|---|---|
| ***A63C 9/02*** | (2012.01) |
| ***A63C 9/00*** | (2012.01) |
| ***A63C 9/08*** | (2012.01) |

(Continued)

(52) U.S. Cl.

CPC ..... *A63C 9/003* (2013.01); *A63C 9/086* (2013.01); *A63C 9/0807* (2013.01); *A63C 9/20* (2013.01); *Y10T 29/49826* (2015.01)

(58) Field of Classification Search

CPC ..... A63C 9/20
USPC ..... 280/614, 615
See application file for complete search history.

(56) References Cited

U.S. PATENT DOCUMENTS 4,533,154 A * 8/1985 Bernard et al. ..... 280/615
4,616,843 A * 10/1986 Freisinger et al. ..... 280/618

(Continued)

FOREIGN PATENT DOCUMENTS

CN 100571825 C 12/2009
DE 102005026725 A1 6/2006

(Continued)

OTHER PUBLICATIONS

Norwegian Search Report for NO20101289, dated Feb. 22, 2011, 2 pages.

(Continued)

*Primary Examiner* — Jeffrey J Restifo
(74) *Attorney, Agent, or Firm* — Harness, Dickey & Pierce, PLC

(57) ABSTRACT

The present invention relates to a touring or cross-country binding comprising: an engagement section (2.1) for pivotal engagement of a ski shoe engagement pin (21); a first housing section (9) provided with an opening (9.2) adapted to receive the engagement section (2.1); at least one resilient element (10) fastenable in front of the engagement section (2.1); and a second housing section (7) connected to the first housing section (9); wherein the resilient element (10) is provided with at least one rear flange (10.1) extending from a rear lower section of the element, wherein the at least one rear flange extends to a position under a bottom surface of the second housing section (9).

10 Claims, 14 Drawing Sheets

(51) Int. Cl.
*A63C 9/086* (2012.01)
*A63C 9/20* (2012.01)

(56) References Cited

U.S. PATENT DOCUMENTS

| | | | | | |
|---|---|---|---|---|---|
| 4,659,103 | A * | 4/1987 | Tessaro | 280/615 |
| 4,787,155 | A * | 11/1988 | Callegari | 36/117.2 |
| 4,915,405 | A * | 4/1990 | Rullier et al. | 280/634 |
| 4,927,168 | A * | 5/1990 | Provence et al. | 280/615 |
| 4,995,632 | A * | 2/1991 | Girault et al. | 280/615 |
| 4,997,199 | A * | 3/1991 | Horn | 280/618 |
| 5,007,656 | A * | 4/1991 | Girault et al. | 280/615 |
| 5,052,710 | A * | 10/1991 | Provence et al. | 280/615 |
| 5,085,454 | A * | 2/1992 | Provence et al. | 280/615 |
| 5,087,065 | A * | 2/1992 | Provence et al. | 280/615 |
| 5,092,620 | A * | 3/1992 | Girault et al. | 280/615 |
| 5,108,125 | A * | 4/1992 | Callegari | 280/615 |
| 5,152,546 | A * | 10/1992 | Dunand et al. | 280/615 |
| 5,224,729 | A * | 7/1993 | Provence et al. | 280/615 |
| 5,228,714 | A * | 7/1993 | Dekanovsky | 280/615 |
| 5,338,053 | A * | 8/1994 | Hauglin | 280/615 |
| 5,664,797 | A * | 9/1997 | Haughlin | 280/615 |
| 5,669,622 | A * | 9/1997 | Miller | 280/615 |
| 5,794,963 | A * | 8/1998 | Girard | 280/615 |
| 5,992,873 | A * | 11/1999 | Hauglin | 280/615 |
| 6,017,050 | A * | 1/2000 | Girard | 280/615 |
| 6,027,135 | A * | 2/2000 | Hauglin | 280/615 |
| 6,290,250 | B1 * | 9/2001 | Karol | 280/618 |
| 6,402,184 | B1 * | 6/2002 | Hauglin | 280/615 |
| 6,412,808 | B1 * | 7/2002 | Chevalier et al. | 280/611 |
| 6,623,027 | B1 * | 9/2003 | Wheeler | 280/623 |
| 6,811,177 | B2 * | 11/2004 | Lancon et al. | 280/615 |
| 6,957,827 | B2 * | 10/2005 | Kogler | 280/613 |
| 7,097,194 | B2 * | 8/2006 | Kogler | 280/615 |
| 7,111,865 | B2 * | 9/2006 | Girard | 280/623 |
| 7,207,591 | B2 * | 4/2007 | Riedel et al. | 280/614 |
| 7,264,264 | B2 * | 9/2007 | Girard | 280/623 |
| 7,644,947 | B2 * | 1/2010 | Girard et al. | 280/615 |
| 7,909,352 | B2 * | 3/2011 | Girard et al. | 280/612 |
| 2003/0127833 | A1 * | 7/2003 | Lancon et al. | 280/615 |
| 2006/0197312 | A1 | 9/2006 | Girard et al. | |
| 2008/0150256 | A1 * | 6/2008 | Girard et al. | 280/612 |
| 2013/0300088 | A1 * | 11/2013 | Wollo et al. | 280/615 |
| 2013/0313807 | A1 * | 11/2013 | Wollo et al. | 280/615 |

FOREIGN PATENT DOCUMENTS

| | | | |
|---|---|---|---|
| EP | 0564442 | A2 | 10/1993 |
| EP | 1848516 | A1 | 10/2007 |
| EP | 1935461 | A1 | 6/2008 |
| FR | 2 582 226 | A1 | 11/1986 |
| FR | 2 634 134 | A1 | 1/1990 |
| FR | 2 741 543 | A1 | 5/1997 |
| NO | 305307 | B1 | 5/1999 |
| NO | 309364 | B1 | 1/2001 |
| WO | WO-9721474 | A1 | 6/1997 |
| WO | WO-2004050197 | A1 | 6/2004 |
| WO | WO-2006082483 | A1 | 8/2006 |
| WO | WO-2011/006542 | A1 | 1/2011 |
| WO | WO-2011/006544 | A1 | 1/2011 |

OTHER PUBLICATIONS

International Search Report for PCT/NO2011/000253, mailed Dec. 29, 2011; ISA/EP.

International Preliminary Report on Patentability for PCT/NO2011/000253, completed Jan. 29, 2013.

* cited by examiner

TOURING OR CROSS-COUNTRY SKI BINDING

CROSS-REFERENCE TO RELATED APPLICATIONS

This application is a 371 U.S. National Stage of International Application No. PCT/NO2011/000253, filed on Sep. 15, 2011, which claims priority to Norwegian Patent Application No. 20101289 filed on Sep. 15, 2010, the contents of which are hereby incorporated by reference in their entirety as if fully set forth herein.

The present invention relates to an improved ski binding for touring or cross-country skiing.

As is well known by any manufacturer of ski bindings, as well as most users of ski bindings, a ski binding should comprise of as few functional parts as possible to functionally flawless in use when exposed to repetitive stress, snow, ice and water entering and freezing within the binding.

Moreover, less functional parts allows easier assembly and lower production cost of the binding. To further reduce production cost while simultaneously offering a high quality binding to a customer at acceptable sale price, is it advantageously to allow most or all of the assembly of the parts of the binding to be performed in a fully automatic process. The fewer manual operations required, the less expensive the binding becomes.

Currently there exists a very large amount of ski bindings on the market, and a substantial number of these bindings is based on the well-known NNN norm, i.e. for use with ski shoes that has a transversal engagement pin mounted underneath the front of the sole of the ski shoe, the binding engaging the engagement pin at either end of the engagement pin or parts of the engagement pin. Several of these ski bindings is constructed in a way that requires several manual and/or complicated automated operations to able to assemble the different parts of the binding. In particular, in an automated assembly operation it is disadvantageous to allow operations performed from different directions, i.e. some operation in a vertical direction, some in a horizontal direction as well as at an angle relative to these directions. Also, rotating an constructional part or element could complicate or add further complexity or cost of the required equipment. Operations in several directions to assemble parts could therefore include joining certain parts either manual or in different position prior to the in-line part assembly.

Most touring and cross-country ski bindings on the market today includes some kind of biasing means providing a return biasing force on the rotation of the ski shoe. A very common biasing means is a resilient element positioned in front of and adjacent to the toe of a ski shoe. The front resilient element experiences a large compressive force as well as an upwards lifting force by the toe of the shoe due to the rotational movement of the shoe as the heel of the ski shoe is rotated toward it highest position. It is a common problem for ski bindings of prior art that the repetitive upwards lifting force at some point pulls the resilient element out of its housing.

Thus, an object of the present invention is to provide a ski binding that comprises a resilient element, that are easy to assemble; and has simple, yet secure fastening means for the resilient element.

The ski binding according to the present invention is defined by claim 1 and accompanying dependent claims 2-5.

An aspect of the present invention relates to a touring or cross-country binding comprising:

an engagement section 2.1 for pivotal engagement of a ski shoe engagement pin 21;

a first housing section 9 provided with an opening 9.2 adapted to receive the engagement section 2.1;

at least one resilient element 10 fastenable in front of the engagement section 2.1; and a second housing section 7 connected to the first housing section 9, wherein the resilient element 10 is provided with at least one rear flange 10.1 extending from a rear lower section of the element, wherein the at least one rear flange extends to a position under a bottom surface of the first housing section 9.

Further, present invention relates to a ski binding as disclosed above having the alternative features, wherein:

the at least one rear flange 10.1 is provided with an opening adapted to engage a pin on the bottom surface of the first housing section 9 or a pin 7.5 on a upper surface of the second housing section 7.

the at least one resilient element 10 is provided with a left 10.2 and right flange 10.3 on the left and right side, respectively, of the resilient element, and the left and right flanges are provided with an opening adapted to engage respective pins on the bottom surface of the first housing section 9 or respective pins 7.6, 7.7 on an upper surface of the second housing section 7.

the at least one resilient element 10 is provided with a traversal flange 10.4 extending from the rear lower section of the resilient element 10 and perpendicular on the at least one rear flange 10.1, wherein the upper surface of the traversal flange 10.4 is substantially in level with the upper surface of the first housing section 9 adjacent to the opening 9.2.

the engagement section 2.1 comprises a pair of locking elements 5.1 that in a locking position extends over the outer ends 10.5, 10.6 of the traversal flange 10.4, whereby the at least one resilient element 10 is fixed in position by the pair of locking elements 5.1.

The invention will now be described in further detail by way of exemplary illustrations herein below. However, it is envisaged that the shape and constructive design of one or more of the parts to be assembled may be modified shape wise without influencing the function and the assembly steps of the binding.

Figure 2:
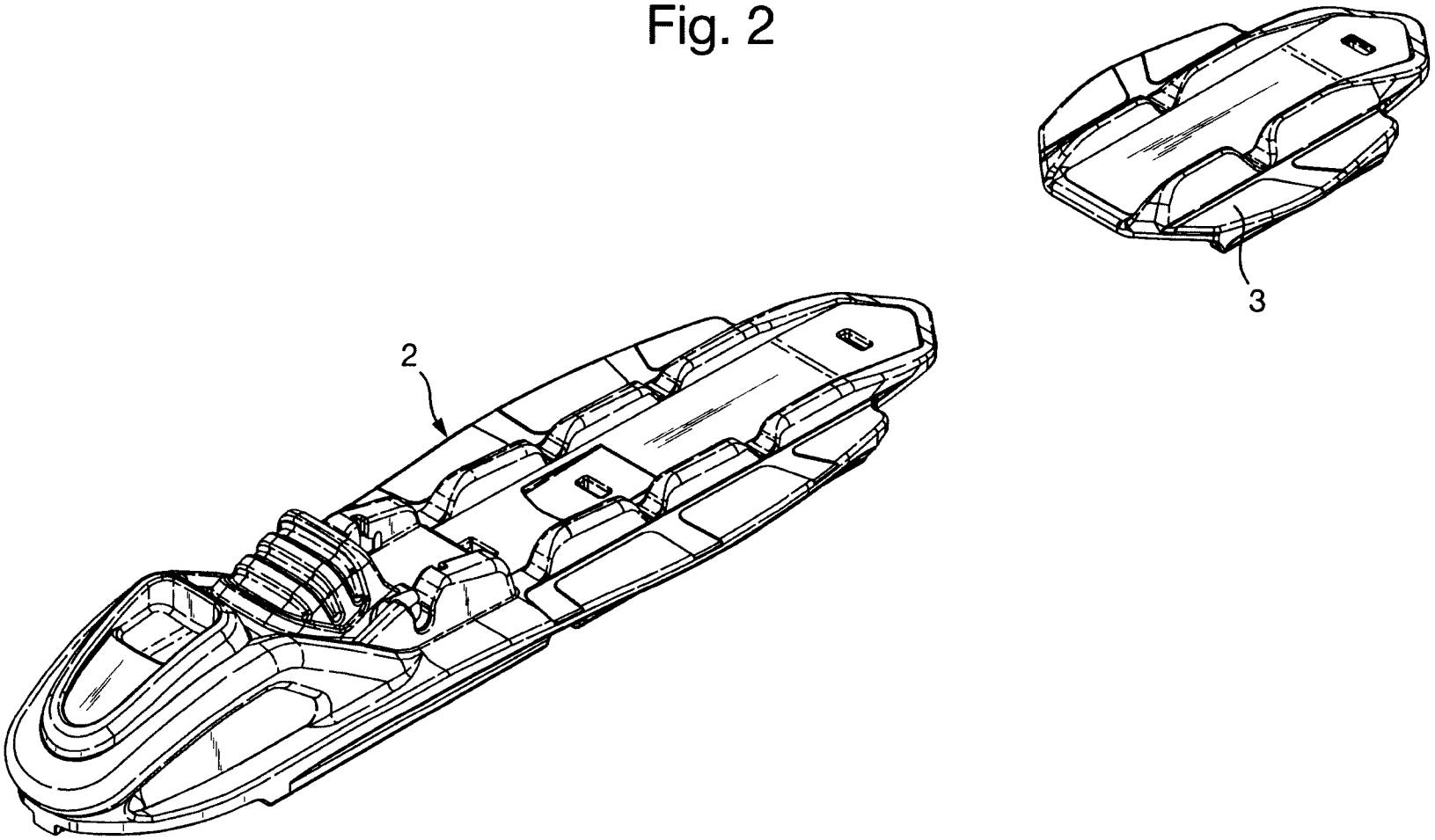
FIG. 2 illustrates a front and back section of the ski binding of FIG. 1.
Figure 4A:
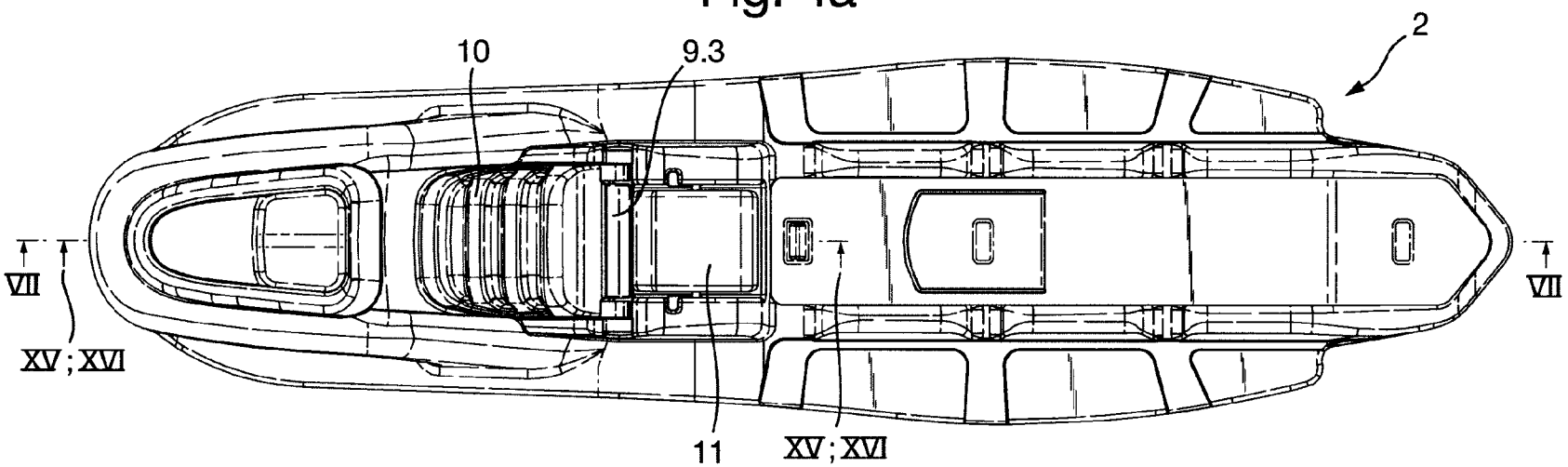
Figure 4B:
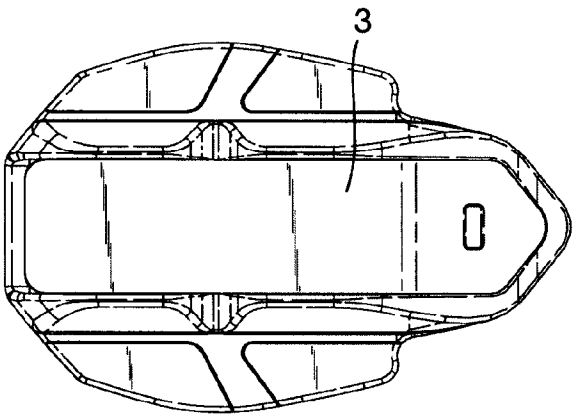
Figure 5A:
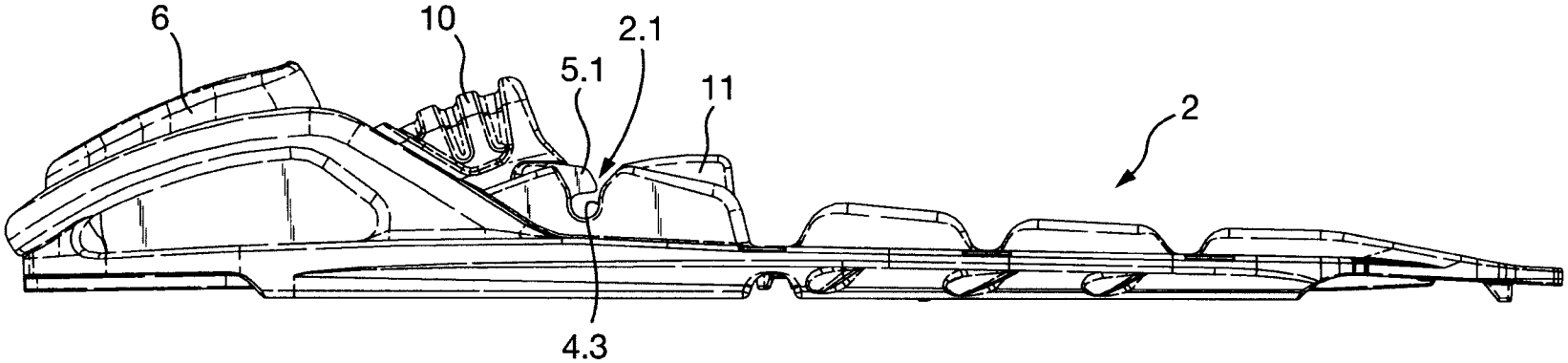
Figure 5B:
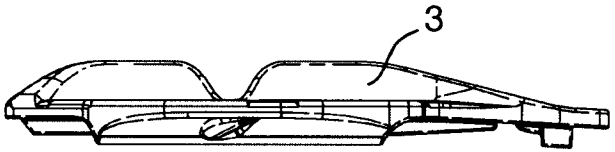
Figure 6A:
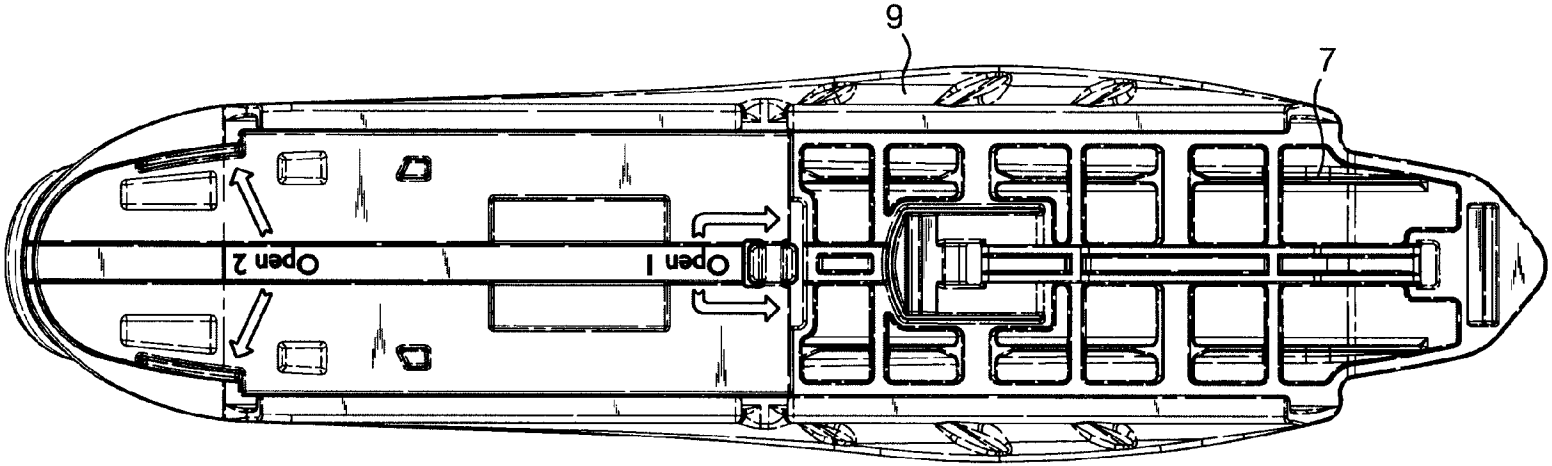
Figure 6B:
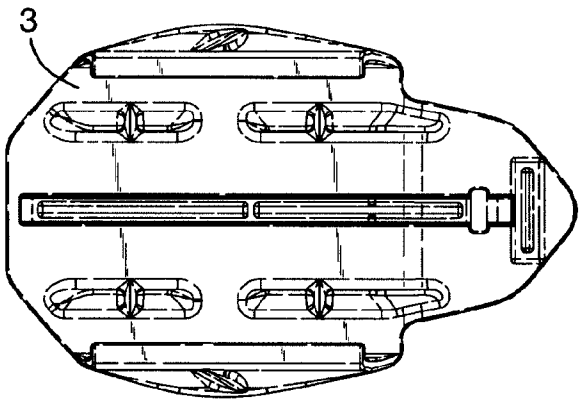
Figure 7:
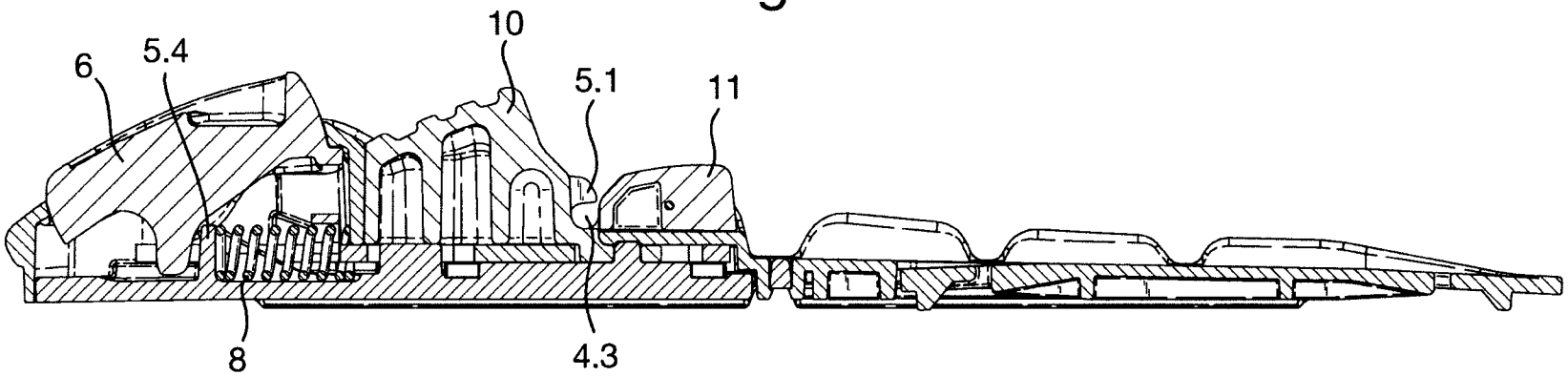

FIGS. 4*a* and 4*b* are top views of the ski binding sections of FIG. 2;

FIGS. 5*a* and 5*b* are side views of the ski binding sections of FIG. 2;

FIGS. 6*a* and 6*b* are bottom views of the ski binding sections of FIG. 2;

FIG. 7 illustrates the cross section VII-VII of FIG. 4*a;*

Figure 9:
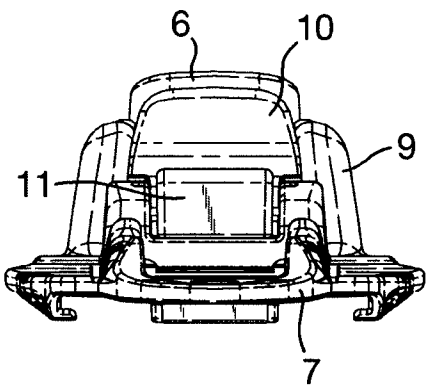
Figure 8:
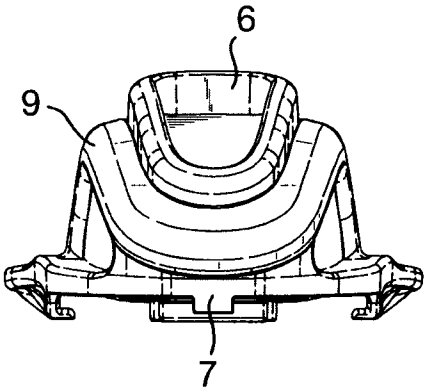

FIGS. 8 and 9 are front and back views of the ski binding section of FIGS. 4*a*, 5*a* and 6*a;*

Figure 10:
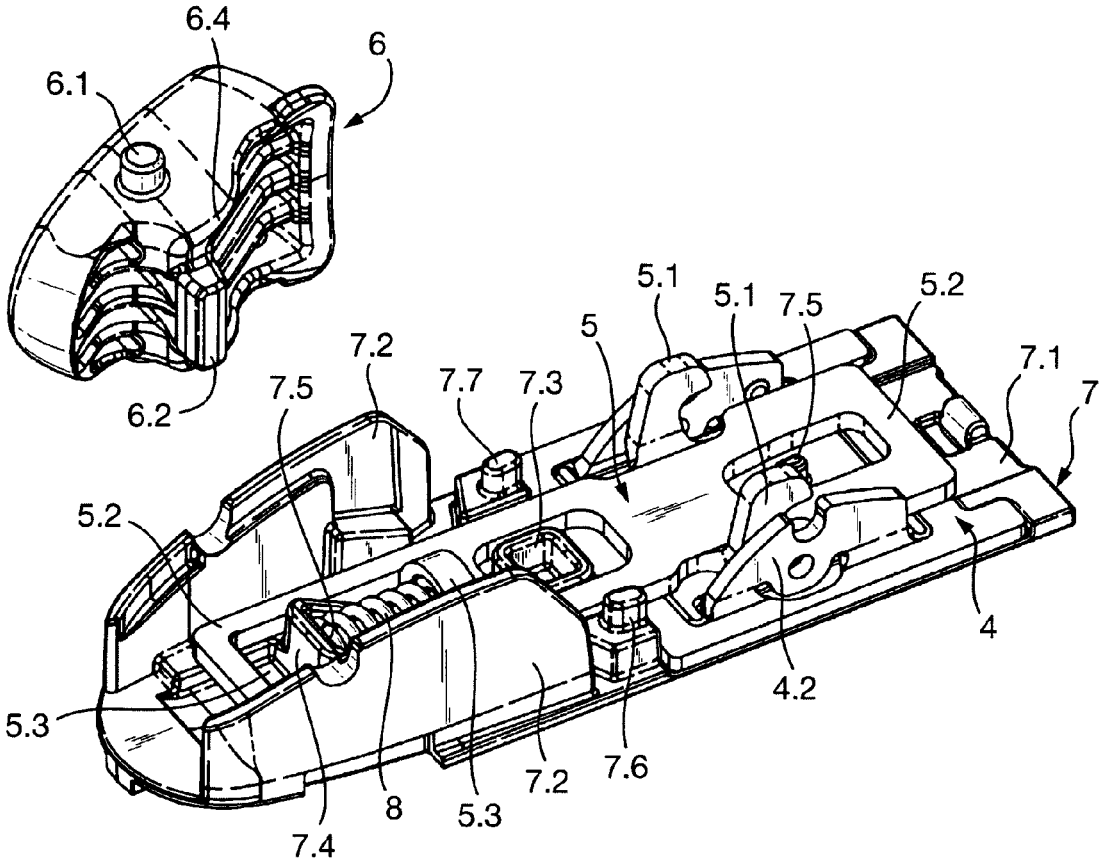
Figure 11:
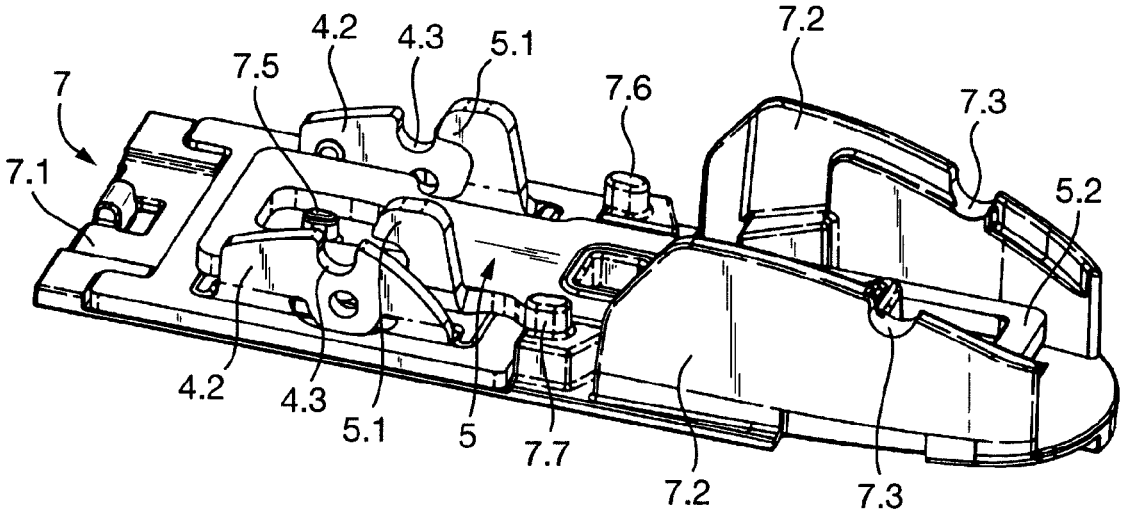
Figure 12:
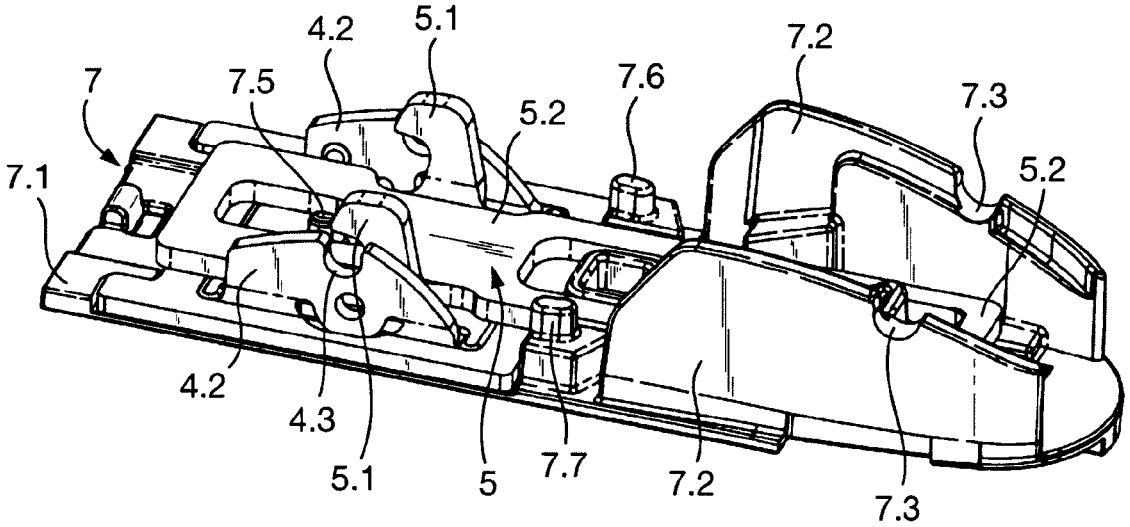

FIG. 10 is a perspective view of the top and a first side of the release- and locking mechanism in the front section of the ski binding according to the present invention;

FIG. 11 is a perspective view of the top and the second side of the release- and locking mechanism of FIG. 10 according to the present invention, and illustrates the locking slide in a released, non-locking position;

FIG. 12 is a perspective view of the top and the second side of the release- and locking mechanism as illustrated in FIG.

10 according to the present invention, and illustrates the locking slide in a locking position.

Figure 13:
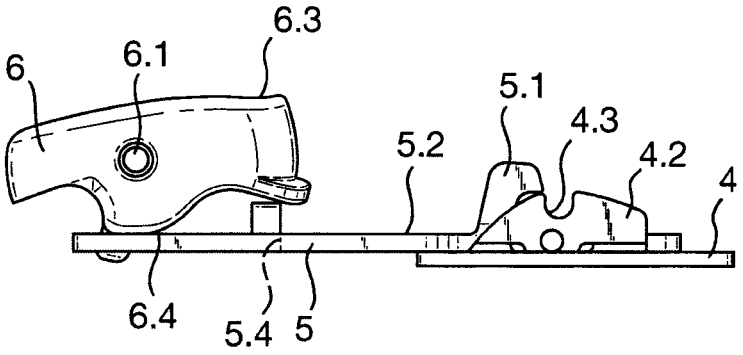
Figure 14:
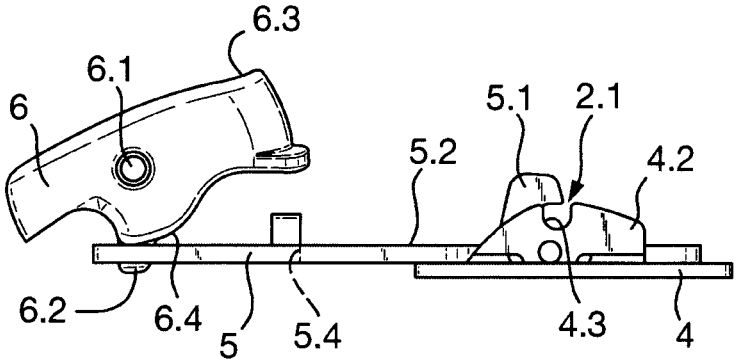

FIGS. 13 and 14 illustrates one operational aspect of the release- and locking mechanism part of the of the front section of the ski binding according to the present invention.

Figure 15:
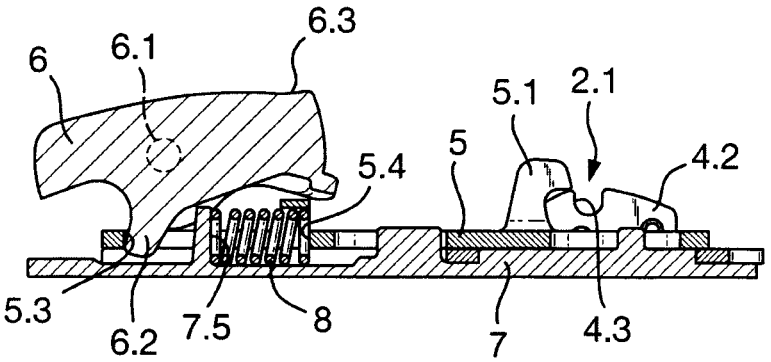
Figure 16:
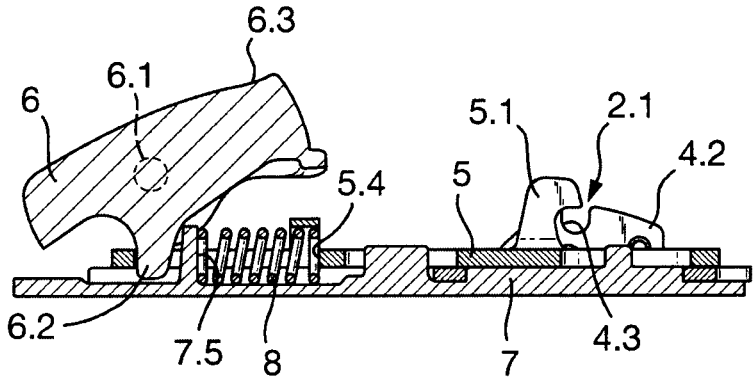
Figure 17:
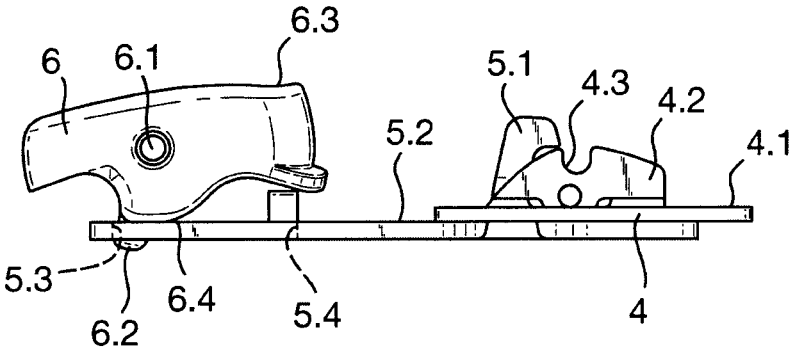
Figure 18:
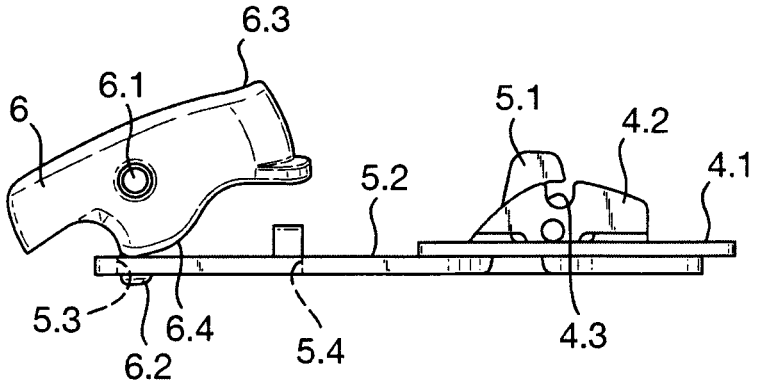
Figure 19:
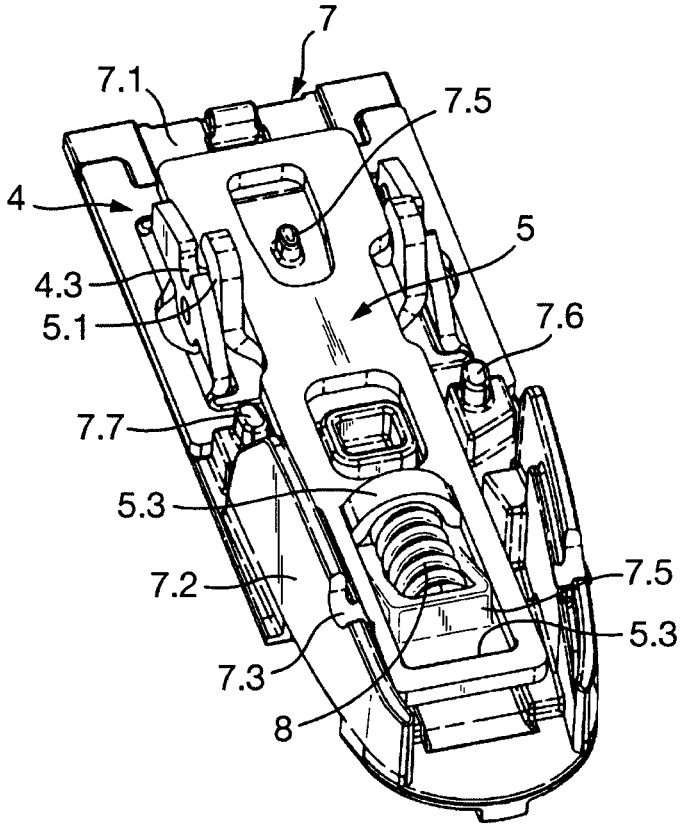
Figure 20:
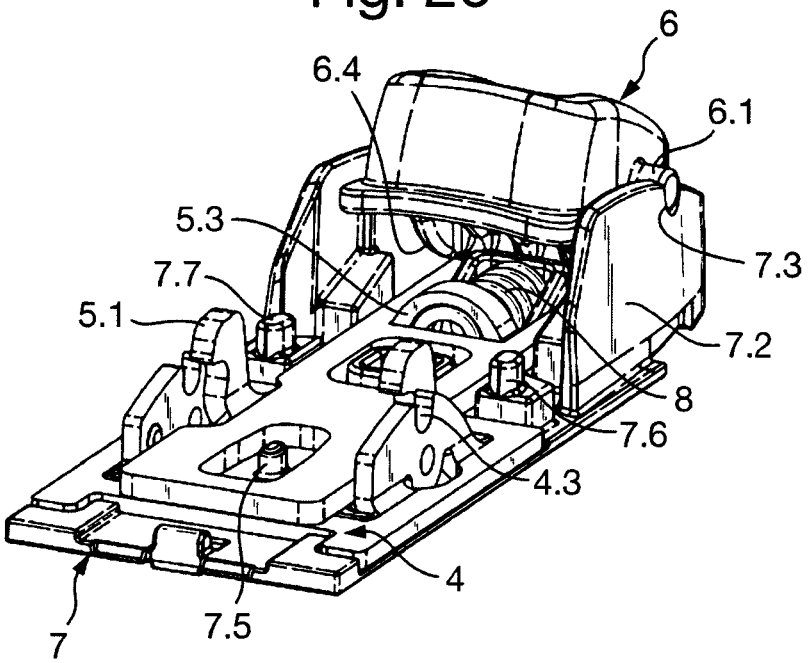
Figure 21:
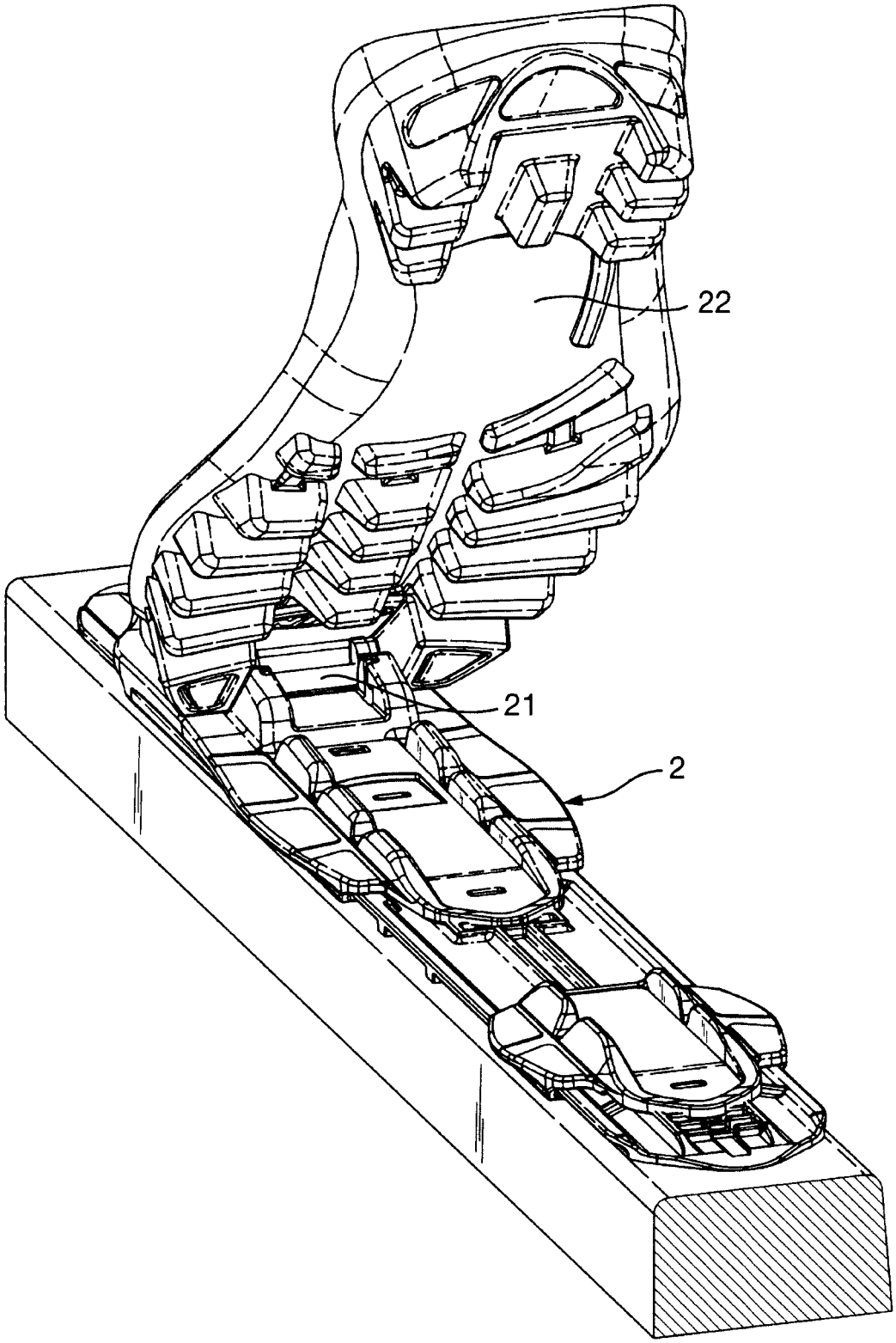
Figure 22A:
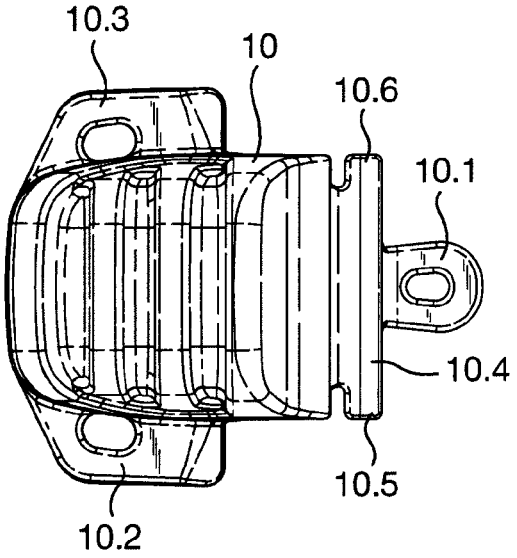
Figure 22B:
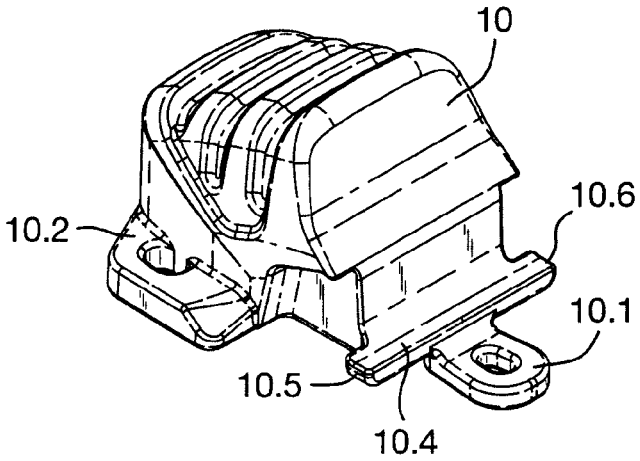
Figure 22C:
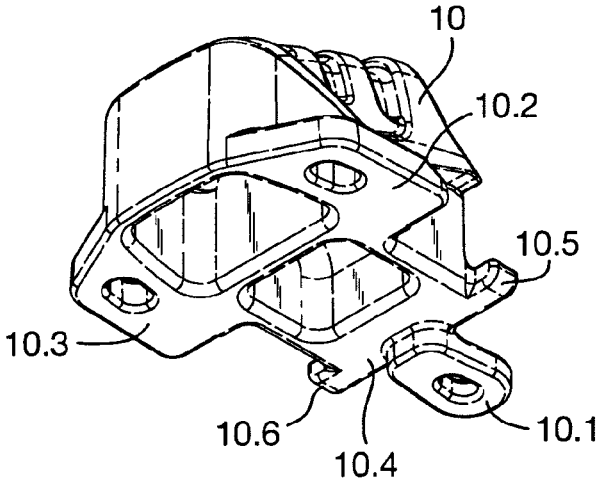

FIGS. 15 and 16 illustrates the cross sections XV-XV and XVI-XVI of FIG. 4*a*, and illustrates a second operational aspect of the release- and locking mechanism of the front section of the ski binding according to the present invention;

FIGS. 17 and 18 represents a modification of the embodiment as illustrated in FIGS. 3, 7 and 10-16;

FIG. 19 is a perspective view of the top and front of the locking mechanism part of FIG. 10 according to the present invention and illustrates the locking slider in a locked position;

FIG. 20 is a perspective view of the top and backside of the locking mechanism part of FIG. 10 according to the present invention and illustrates the locking slider in a locking position;

FIG. 21 illustrates a complete ski binding mounted on a ski binding attachment base-element according to the present invention, where the sole of a ski shoe is in a lifted position and locked to the binding;

FIGS. 22*a*, 22*b* and 22*c* are perspective views an resilient element according to the present invention.

Figure 1:
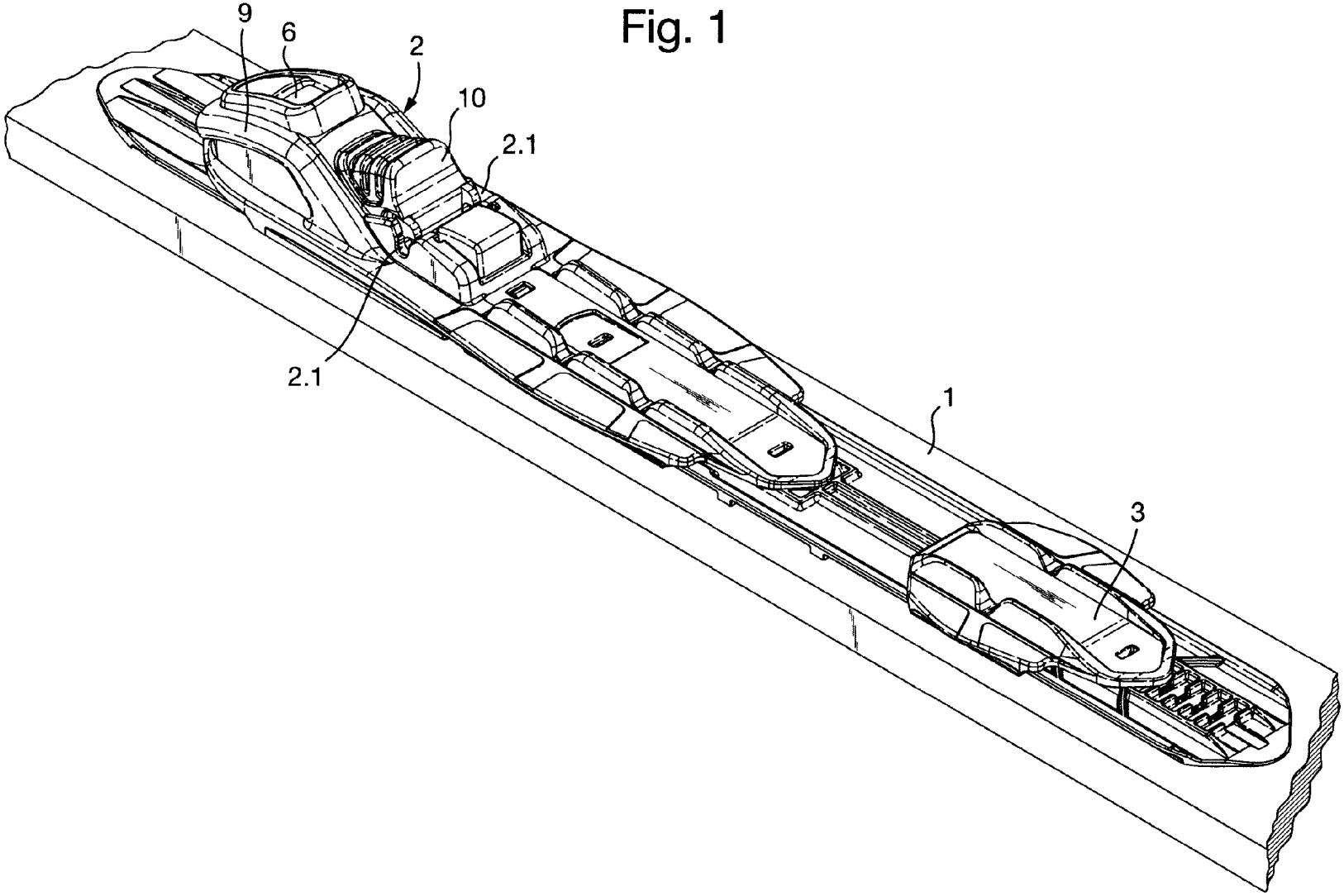
FIG. 1 illustrates a complete ski binding mounted on a ski by a binding attachment base-element according to the present invention.

FIG. 1 illustrates a ski binding 2,3 fixed to the upper surface of a ski 1, where the ski binding comprises a front element having an engagement section 2.1 for pivotal engagement of a ski shoe engagement pin 21, and a rear binding element 3 for engagement with a slit in the underside of the heel of the ski shoe. The front and rear elements of the ski binding also appears from FIG. 2. The ski have on its upper surface a ski binding fastening base element 1.1, e.g. a so called NIS-plate, to which the front and rear binding elements 2,3 can be releasable fastened by snap fastening. Also, by utilizing such an element 1.1 adjustable positioning of the elements 2,3 along the ski becomes possible to adjust to the ski shoe size and the substantially vertical load on the ski. The base element 1.1 can be fastened to or integrated with a ski 1. Alternatively, could the elements 2,3 be fastened to the ski by use of regular screws or other fastening means could be used.

Figure 3:
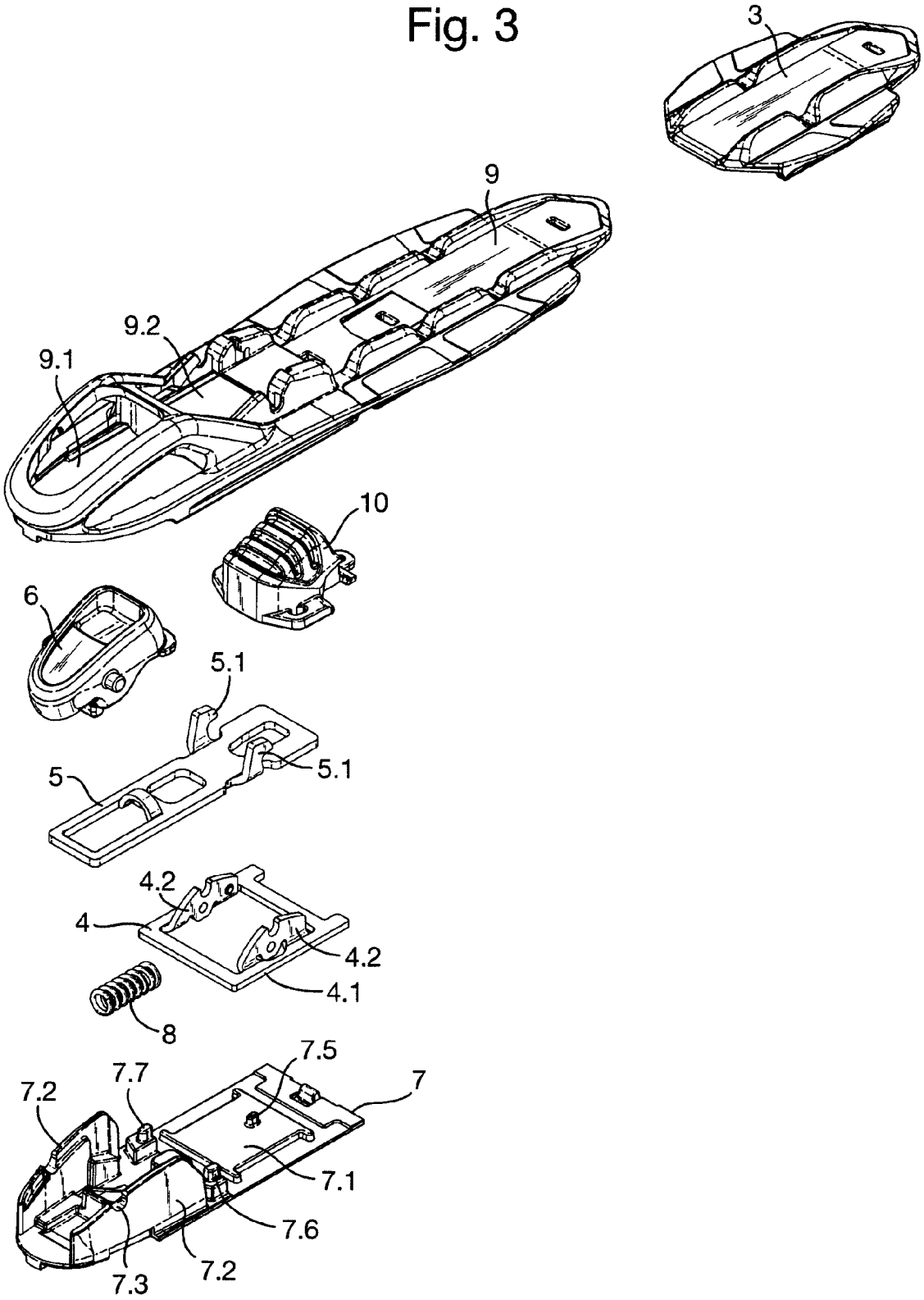
FIG. 3 is an exploded view of the ski binding sections of FIG. 2.

Now with reference to FIG. 3 showing an exploded view of the ski binding. The engagement section 2.1 of the binding includes a first stationary engagement part 4 and a movable engagement part 5. A spring-loaded activation element 6 is also provided to move the movable engagement part 5 between a locking position and a release position of the ski shoe. Further, a second housing section 7 exists having a bottom 7.1 and a pair of side elements 7.2 extending from the bottom 7.1 and providing bearing surfaces 7.3 for the fulcrum pins 6.1 of the activation element 6.

The stationary engagement part 4 includes a base 4.1 and a pair of protruding elements 4.2, which at top have recesses 4.3 to provide the engagement section 2.1, as shown in more detail in FIG. 10-20.

The movable engagement part 5 is a slider in sliding engagement with the stationary engagement part 4 and in sliding engagement with slider guides 7.4 of the second housing section 7. The movable engagement part 5 includes at a rear area thereof a pair of protruding locking elements 5.1, e.g. hook shaped elements, extending from a base 5.2 of the movable engagement part 5. Each locking element 5.1 in locking position for the movable engagement part 5 is positioned sideways in relation to adjacent recess 4.3 on the stationary engagement section 4 to provide in co-operation with said recess 4.3 a means for locking the engagement pin 21, see FIGS. 11, 13, 15, 17 and 20. Each locking element 5.1 in ski shoe releasing position of the movable engagement part 5 is positioned forward in relation to the adjacent recess 4.3 of the stationary engagement part 4, that is, displaced from the recess 4.3 in the lengthwise direction of the binding, see FIGS. 12, 14, 16 and 18.

Activation element 6 includes a button 6.2 extending downwards to directly engage an forward positioned opening 5.3 in the slider, whereby the slider 5 is slided forward to a releasing position by a downwards pushing operation on the activation element 6 at a position behind its fulcrum pins 6.1. A lower edge 6.4 of each sidewall of the activation element, at a position below the fulcrum pins 6.1, is curved. The curved lower edge 6.4 sits on a neighboring surface of the base 5.2 of the slider shaped movable engagement part 5 to reduce the stress on the fulcrum pins 6.1.

A spring 8 is positioned between an abutment 7.5 at the bottom 7.1 of the second housing section 7 and an abutment 5.4 on the slider shaped movable engagement part 5 to provide spring loading of the movable engagement part 5 and the activation element 6.

As illustrated in FIGS. 3 and 10-16, the stationary engagement part 4 is positioned under the slider shaped movable engagement part 5 and rests on the bottom 7.1 of the first housing section, whereby the movable engagement part 5 at its front area is sliding on top of the bottom 7.1 of the second housing section 7 and at its rear area slides on top of the stationary engagement section 4.

In the alternative illustrated in FIGS. 17 and 18, the stationary engagement part 4 is positioned above the slider shaped movable engagement section 5, and the stationary engagement section 4 has feet or other types of fastening means (not clearly shown) resting on the bottom 7.1 of the second housing section 7, whereby the movable engagement part 5 on its underside is sliding on the bottom 7.1 of the second housing section 7 and with its upper surface of its rear area sliding connects with a underside surface of the stationary engagement part 4.

The element 6 acts as a release mechanism, and due to the button 6.2 co-operating with opening 5.3 of the movable engagement part 5, and the part 5 is spring-loaded by the spring 8, element 6 is also spring-loaded. It should be noted that the outside of engagement pocket 7.5 constitute one of the guides 7.4 for part 5.

An important aspect of the present invention is that element 6 is arranged to directly exert a force on the movable engagement section 5, that in reality constitutes a ski shoe fastening element.

By activation of the release element 6 by exertion of a release force, e.g. by utilizing the pointed end of a ski pole; on position 6.2, is a substantial stress applied the fulcrum pins 6.1 from the bearing surfaces 7.3 on the side elements 7.2 provided a remedy is provided to reduce such stress. To avoid breakage in the release mechanism, i.e. fulcrum pins 6.1, as a result of substantial vertical release force, represents the provision of the curved bottom edge 6.4 to ride the adjacent surface of the base 5.2 of the slider shaped movable engagement part 5, that the vertically directed stress component exerted on the fulcrum pins is substantially reduced, and the smaller stress component working in the vertical direction on the fulcrum pins, will have an acceptable value. Hence, the stress exerted on the fulcrum pins will be within fully acceptable limits. The risk of malfunction is with that removed. It should also be envisaged that when element 6 via its button 6.2 displaces the movable engagement part 5 in a forwards direction, the curved bottom edge 6.4 by frictional contact with the base 5.2 of the part 5 assist the operation of the button 6.2.

FIG. 21 illustrates the sole of a ski shoe or ski boot wherein the front area of the sole comprises an engagement pin 21 attached to the ski binding 2, whereby the engagement pin is lies in the engagement section 2.1 and is locked by locking element 5.1.

As indicated in the exploded view of FIG. 3 is a second housing part 9 provided, the first housing section 9 being adapted to snap connection from above on the second housing section 7. The first housing section 9 has at a front area thereof a pair of recesses 9.1 for pivotal engagement with an upper part of the fulcrum pins 6.1. The first housing section 9, at the position of the protruding elements 4.2, 5.1 of the stationary and movable engagement parts 4, 5, an opening 9.2. The first housing section 9 effects that the fulcrum pins 6.1 of the element 6 is limited in upwards movement, and also effects that the stationary and movable engagement element 5, 6 is limited in upwards movement.

Further, as illustrated in FIG. 3, at least one resilient elements 10, 11 is fastenable to the first housing section 9, where at least one resilient element is fastenable in front of or behind the engagement section 2.1 for pivotal engagement of the ski shoe. The front resilient elements 10 is preferably fastenable to the first housing section 9 from underneath the first housing section 9. The behind, or rear, resilient element 11 is fastenable to the second housing section from above by snap connection.

Now also with reference to FIGS. 22*a*-22*c*, the front resilient element of the present invention is provided with at least one rear flange 10.1 extending from a rear lower section of the element. The at least one rear flange extends under the first housing section 9 when the resilient element is mounted in the opening 9.2 of the first housing section 9, such that the resilient element is kept in position by a bottom surface of the first housing section 9. To further secure the resilient element the rear flange can also be provided with an opening adapted to engage a pin, where the pin is positioned on the bottom surface of the first housing section 9 or on a upper surface of the second housing section 7.

The front resilient element is also provided with a left 10.2 and right flange 10.3 provided on the left and right side, respectively, of the resilient element. The flanges are adapted to fit into correspondingly shaped seats in the first housing section 9. As illustrated in FIG. 3, these left and right flanges are further provided with openings adapted to engage respective pins on the bottom surface of the first housing section 9 or on an upper surface of the second housing section 7. An exemplary second housing section 7, also illustrated in FIG. 3, shows three resilient element engagement pins 7.5, 7.6, 7.7 arranged on the second housing section 7, respectively adapted to engage the rear flange 10.1, left flange 10.2 and right flange 10.3.

According to yet an exemplary embodiment of the present invention the front resilient element is further provided with an traversal flange 10.4 extending from the rear lower section of the resilient element 10, wherein the upper surface of the traversal flange 10.4 is substantially in level with the upper surface of the first housing section 9 adjacent to the opening 9.2 when the resilient element is mounted in the second housing section. In the assembled ski binding illustrated in FIG. 4*a*, the traversal flange 10.4 covers the ski shoe engagement pin reception area 9.3, such that when in use, during the forward rotation of a ski shoe, downwards and backwards forces are exerted on the traversal flange 10.4 by the ski shoe engagement pin 21.

Further, according to another exemplary aspect of the present invention, the engagement section 2.1 of the assembled ski binding comprises a pair of locking elements 5.1 that in the locking position extends over the outer ends 10.5, 10.6 of the traversal flange 10.4, such that the front resilient element is fixed in position by the pair of locking elements 5.1.

The elements 12, 13 in FIG. 3 is only plates of decorative and cover purposes and have no further functionality.

As is understood from viewing FIG. 3, the second housing section 7, the stationary engagement part 4, the movable engagement part 5, the spring 8, the activation element 6, and the first housing section 9, all capable of being assembled by successive vertical directed mounting steps. To further explain the method steps of assembly of the functional parts of the touring- and cross-country ski binding, according to the present invention, comprises the following steps:

a) providing the second housing section 7;

b) downwards vertical moving one end of a spring 8 against an abutment 7.5 of the second housing section 7, whereby the spring extends in longitudinal direction of the second housing section 7;

c) positioning, by downwards vertical motions, the stationary 4 and movable 5 engagement parts on the bottom 7.1 of the second housing section 7, whereby the movable engagement part 5 is arranged in sliding engagement with guides 7.4 of the first housing section and in abutment with the second end of the spring 8;

d) positioning, by a downwards vertical motion, the activation element 6 on the second housing section 7, whereby the downwards pointing button 6.2 of the activation element 6 is arranged in abutment with the opening 5.3 in front of the movable engagement part 5; and e) connecting by a downwards vertical motion, the first housing section 9 on the second housing section 7 by means of an interlocking snap connection.

An important aspect of the method disclosed above is the fact that the ski binding can be assembled for one side only, and mainly in the same inserting direction. As such, the ski binding of the present invention can also be assembled by following steps:

a) providing and turning the second housing section 7 upside down;

b) positioning, by a downwards vertical motion, the activation element 6 on the first housing section 9, thereby positioning the fulcrum pins 6.1 of the activation element into the recesses 9.1 of the second housing section, and the downwards (that is, as long as the second housing section is upside down, actually pointing upwards) pointing button 6.2 of the activation element 6 is arranged in abutment with the opening 5.3 in front of the movable engagement part 5;

c) positioning, by downwards vertical motions, the stationary 4 and movable 5 engagement parts on the underside of the second housing section, whereby the pair of protruding elements 4.2 and the at least one locking element 5.1 is accommodated in the opening 9.2 of the first housing section 9;

d) downwards vertical moving one end of a spring 8 against the abutment 5.4 of the movable engagement part 5, whereby the springs in longitudinal direction of the first housing section 9;

e) connecting by a downwards vertical motion, the second housing section 7 on the first housing section 9 by means of an interlocking snap connection, whereby the movable engagement part 5 is arranged in sliding engagement with guides 7.4 of the first housing section and in abutment with the second end of the spring 8.

Step c) of either of the above disclosed methods comprises positioning the stationary engagement part 4 prior to providing the movable engagement part 5, as illustrated in FIGS. 3 and 10-16.

In an alternative, as also explained above with reference to the FIGS. 17 and 18, can step c) comprise positioning the movable engagement part 5 prior to positioning the stationary engagement part 4.

As disclosed above, according to the first method the resilient element 10 is inserted from below in front of the engagement section 2.1 in the opening 9.2 of the first housing section 9 prior to performing step e), and the element can have holes adapted for tight fitting on pins on underneath the first housing section 9.

It is envisaged that if the ski binding is assembled manually, then no tools are required to perform the operations. If the operations is automated by use of robots, then no sophisticated tools are required. FIGS. **4*a*-9 are merely attached to illustrate how the invention can be utilized industrially, with additional guidance from the exploded view of FIG. 3, and the detail of the release- and ski boot fastening mechanism illustrated in FIGS. 10-21**.

The invention claimed is:

1. A touring or cross-country binding comprising:

an engagement section for pivotal engagement of a ski shoe engagement pin;

a first housing section provided with an opening adapted to receive the engagement section;

at least one resilient element fastenable in front of the engagement section; and a second housing section connectable to the first housing section, characterized in that said at least one resilient element is provided with a traversal flange and at least one rear flange, the at least one rear flange extending from a rear lower section of the element, the traversal flange extending from the rear lower section of the resilient element and perpendicular on the at least one rear flange, wherein the at least one rear flange extends to a position under a bottom surface of the first housing section, said at least one rear flange comprising an opening adapted to engage a pin on the bottom surface of the first housing section or on an upper surface of the second housing section, said resilient element securely fixed in position when the first housing section and second housing section are connected, wherein an upper surface of the traversal flange is substantially in level with the upper surface of the first housing section adjacent to the opening.

2. The binding according to claim 1, wherein the at least one resilient element is provided with a left and right flange on the left and right side, respectively, of the resilient element, said left and right flanges being provided with openings adapted to engage respective pins on the bottom surface of the first housing section or on the upper surface of the second housing section.

3. The binding according to claim 1, wherein the engagement section comprises a pair of locking elements that in a locking position extends over outer ends of the traversal flange, whereby the at least one resilient element is fixed in position by the pair of locking elements.

4. The binding according to claim 1, wherein the engagement section includes a stationary engagement part, a movable engagement part, and an activation element operable to move the movable engagement part relative to the stationary engagement part.

5. The binding according to claim 4, wherein the first housing section includes a pair of recesses and the activation element includes a pair of fulcrum pins pivotally disposed within the pair of recesses.

6. A touring or cross-country binding comprising:

an engagement section for pivotal engagement of a ski shoe engagement pin;

a first housing section provided with an opening adapted to receive the engagement section;

at least one resilient element fastenable in front of the engagement section; and a second housing section connectable to the first housing section, characterized in that said at least one resilient element is provided with a left flange on the left side of the resilient element, a right flange on the right side of the resilient element, and at least one rear flange, the at least one rear flange extending from a rear lower section of the element, wherein the at least one rear flange extends to a position under a bottom surface of the first housing section, said at least one rear flange comprising an opening adapted to engage a pin on the bottom surface of the first housing section or on an upper surface of the second housing section, and wherein the left and right flanges are provided with openings adapted to engage respective pins on the bottom surface of the first housing section or on the upper surface of the second housing section, said resilient element securely fixed in position when the first housing section and second housing section are connected.

7. The binding according to claim 6, wherein the at least one resilient element is provided with a traversal flange extending from the rear lower section of the resilient element and perpendicular on the at least one rear flange, wherein the upper surface of the traversal flange is substantially in level with the upper surface of the first housing section adjacent to the opening.

8. The binding according to claim 7, wherein the engagement section comprises a pair of locking elements that in a locking position extends over the outer ends of the traversal flange, whereby the at least one resilient element is fixed in position by the pair of locking elements.

9. The binding according to claim 6, wherein the engagement section includes a stationary engagement part, a movable engagement part, and an activation element operable to move the movable engagement part relative to the stationary engagement part.

10. The binding according to claim 9, wherein the first housing section includes a pair of recesses and the activation element includes a pair of fulcrum pins pivotally disposed within the pair of recesses.

* * * * *